US007665321B2

(12) United States Patent
Meister

(10) Patent No.: US 7,665,321 B2
(45) Date of Patent: Feb. 23, 2010

(54) EVAPORATION PROCESS CONTROL USED IN REFRIGERATION

(75) Inventor: Remo Meister, Merligen (CH)

(73) Assignee: BMS-Energietechnik AG, Wilderswil (CH)

( * ) Notice: Subject to any disclaimer, the term of this patent is extended or adjusted under 35 U.S.C. 154(b) by 490 days.

(21) Appl. No.: 10/538,700

(22) PCT Filed: Dec. 11, 2002

(86) PCT No.: PCT/CH02/00685

§ 371 (c)(1),
(2), (4) Date: Jun. 10, 2005

(87) PCT Pub. No.: WO2004/053406

PCT Pub. Date: Jun. 24, 2004

(65) Prior Publication Data

US 2006/0242974 A1 Nov. 2, 2006

(51) Int. Cl.
*F25B 41/04* (2006.01)
*F25B 41/00* (2006.01)

(52) U.S. Cl. ..... 62/222; 62/210

(58) Field of Classification Search ..... 62/210, 62/212, 222, 224

See application file for complete search history.

(56) References Cited

U.S. PATENT DOCUMENTS

| | | | | |
|---|---|---|---|---|
| 4,835,980 | A | 6/1989 | Oyanagi et al. | |
| 4,878,355 | A | 11/1989 | Beckey et al. | |
| 6,105,386 | A * | 8/2000 | Kuroda et al. | 62/513 |
| 6,523,360 | B2 * | 2/2003 | Watanabe et al. | 62/204 |
| 6,574,977 | B2 * | 6/2003 | Ozaki et al. | 62/210 |
| 6,588,223 | B2 * | 7/2003 | Dienhart et al. | 62/228.3 |
| 6,786,057 | B2 * | 9/2004 | Ben Yahia | 62/222 |
| 6,817,193 | B2 * | 11/2004 | Caesar et al. | 62/133 |
| 7,076,964 | B2 * | 7/2006 | Sakakibara | 62/238.6 |

FOREIGN PATENT DOCUMENTS

| | | |
|---|---|---|
| DE | 4430468 | 2/1996 |
| DE | 19506143 | 9/1996 |
| DE | 10053203 | 6/2001 |
| EP | 1014013 | 6/2000 |
| JP | 2002 267279 | * 9/2002 |
| WO | WO 02/086396 | 10/2002 |

* cited by examiner

*Primary Examiner*—Chen-Wen Jiang
(74) *Attorney, Agent, or Firm*—The Webb Law Firm

(57) ABSTRACT

The invention relates to an evaporator control by use of an expansion valve and an internal heat exchanger IHE. The evaporator control is controlled after the start of the evaporation process and the temperature of the compressor suction vapor, oil and hot gas as well as coolant liquid is controlled and regulated upstream of the expansion valve.

15 Claims, 11 Drawing Sheets

EVAPORATION PROCESS CONTROL USED IN REFRIGERATION

BACKGROUND OF THE INVENTION (1) Field of the Invention

Evaporation of refrigerant in cooling and freezing plants, refrigeration engineering, refrigeration machine for cooling and heating operation, refrigeration plants, refrigeration sets, heat pumps, air-conditioning systems and others.

(2) Description of the Related Art

Evaporator control with drive dry expansion on the basis of the minimum stable signal (MMS) is illustrated in (FIGS. 1, 2 and 3).

For optimum operation of an evaporator used in refrigeration, the evaporator is supplied with sufficient wet steam for a control valve (expansion valve) (3) to be controlled to a minimum stable signal, normally on the basis of the evaporator outlet pressure (12) and the associated evaporator outlet temperature (13) (drawing FIGS. 1, 2 and 3). The difference between the evaporator pressure, converted by calculation into the associated evaporation temperature, and the actual evaporation temperature measured is used as measured variable for the control valve. In this context, the aim is stable control characteristics with as low a temperature difference as possible. As low a temperature difference as possible leads to a higher evaporator power. If the difference is too low or the signal is not stable, liquid shocks or power reduction occur at the compressor (1). If the difference is too great, the evaporator power (4) is reduced.

Automatic valves, capillary tubes or other equipment are also dimensioned and used on the basis of the same principle (superheated refrigerant vapor at the end of the evaporation process).

Nowadays, in some cases internal heat exchangers (IHEs) (5) (FIG. 4, 5, 6) are connected downstream of the evaporator. However, these internal heat exchangers are designed as "thermally short" equipment and are not incorporated in the evaporator control on the basis of the entry vapor content. The refrigerant liquid is not strongly cooled and the suction vapors are not strongly superheated. The superheating of the suction vapor is restricted to approx. 5-10K. Injection valves which are customary nowadays are also not designed for maximum superheating, and the superheating which can be set is at most approx. 20-25K.

SUMMARY OF THE INVENTION

A refrigeration system substantially comprising one or more:

Liquefiers (2), evaporators (4), IHEs (5), refrigerant compressors (1), expansion valves (3), refrigerants, refrigeration auxiliary substances and oil.

A refrigeration system, depending on its application, optionally also has one or more of the above-mentioned components and, in addition deheaters (24), one or more waste heat utilization exchangers, further supercoolers (25), viewing windows (7), driers (6), filters, valves (8), safety equipment, shut-off equipment, accumulators, oil pumps, distribution systems, electrical and control parts, refrigeration auxiliary substances, etc.

When fitting the expansion valve (3) upstream of the evaporator (4), the measured value for limiting suction vapor is taken off at the suction line leading to the refrigerant compressor (1). The measured values for the refrigerant liquid temperature (11) and the evaporator entry pressure (12) are used to control the evaporation (17, 19).

Alternatively, the measured values for the high pressure (22) upstream of the expansion valve (3) and for the suction vapor pressure (12) downstream of the expansion valve (3), as well as the hot-gas temperature (15) downstream of the compressor (1) or the oil temperature (16) of the latter, are likewise available for controlling the evaporator (4) with downstream IHE (5).

DETAILED DESCRIPTION OF THE INVENTION

It is an object of the invention to achieve the following in cooling/freezing plants, refrigeration machines for cooling and heating operation, refrigeration plants, refrigeration sets, heat pumps, air-conditioning systems and all other systems using refrigerant for evaporation:

To keep the suction vapor superheating in the evaporator (4) at a low level or to leave the evaporator (4) with wet steam, and in this case keeping the suction vapor superheating upstream of the compressor (1) as high as possible (as far as the use limits of the compressor, the oil or the refrigerant and/or the various temperature ratios permit).

Figure 7:
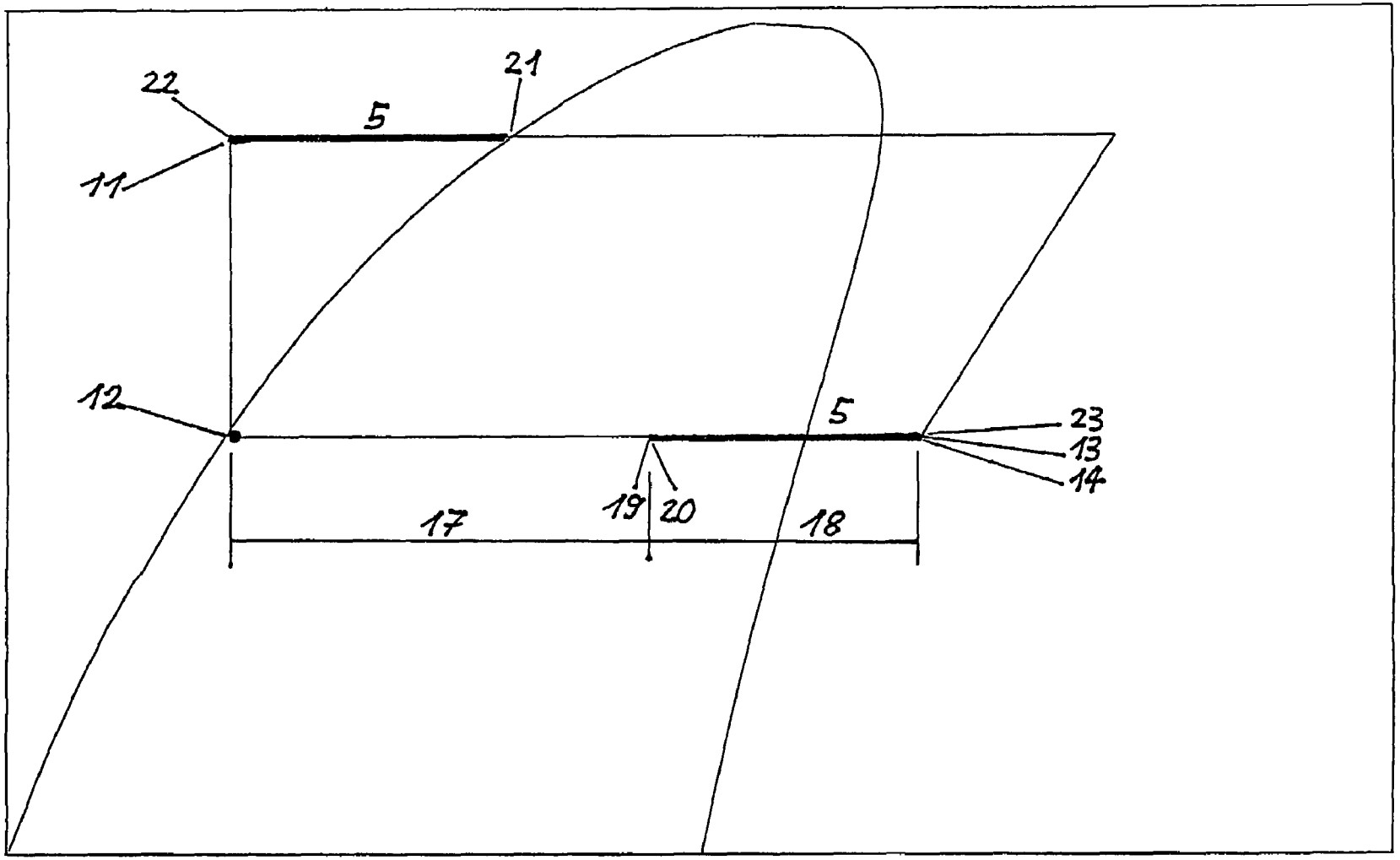
FIG. 7 shows the refrigerant circuit in the lg p, h diagram with two-stage evaporator of the "patent"

For this purpose, the refrigeration plant, which primarily comprises compressor (1), condenser (2), expansion valve (3) and evaporator (4), is provided with an additional internal heat exchanger (5), referred to below as IHE (FIG. 7, 8, 9, 10, 11).

Figure 8:
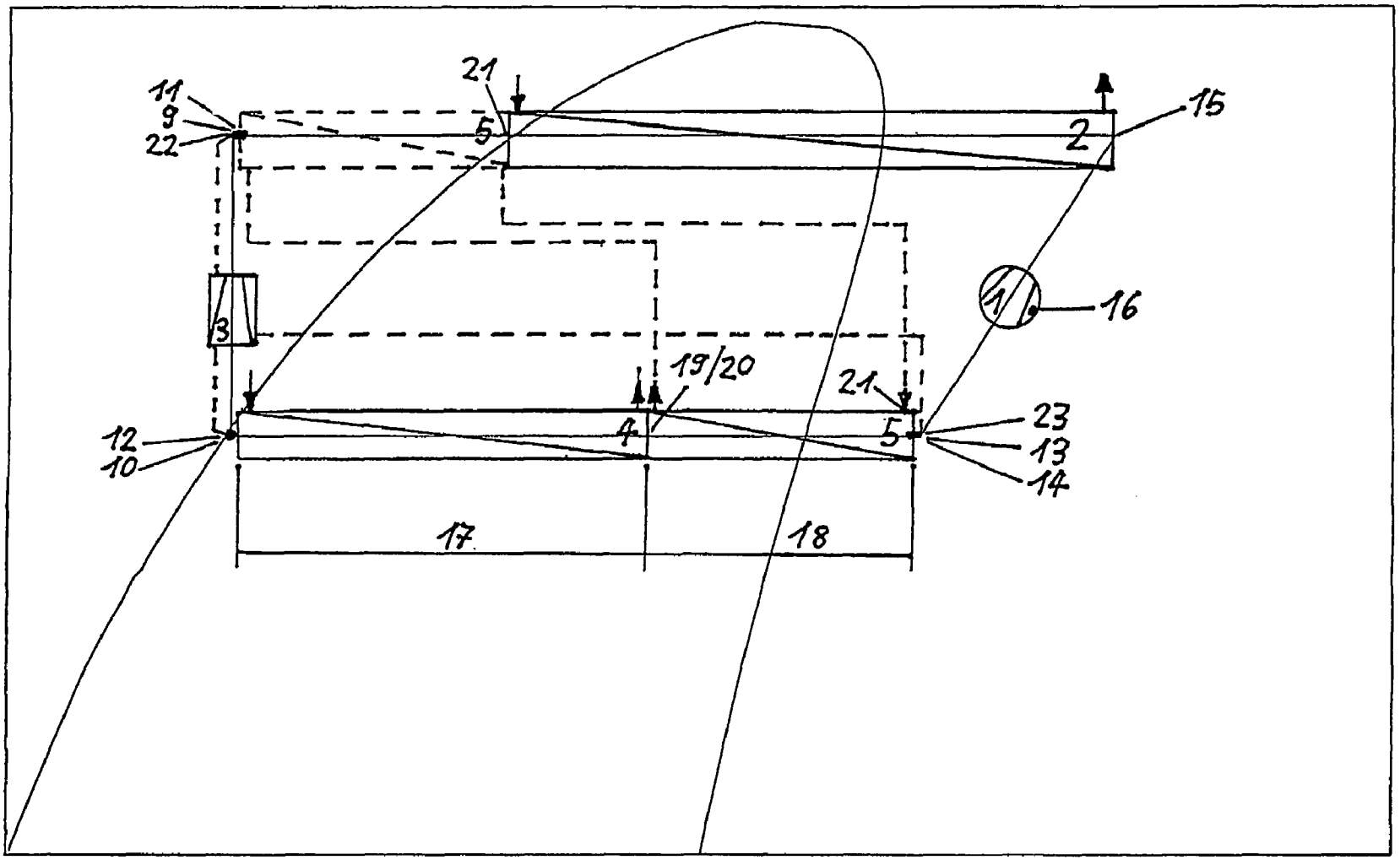
FIG. 8 shows the refrigerant circuit with two-stage evaporator of the "patent"
Figure 9:
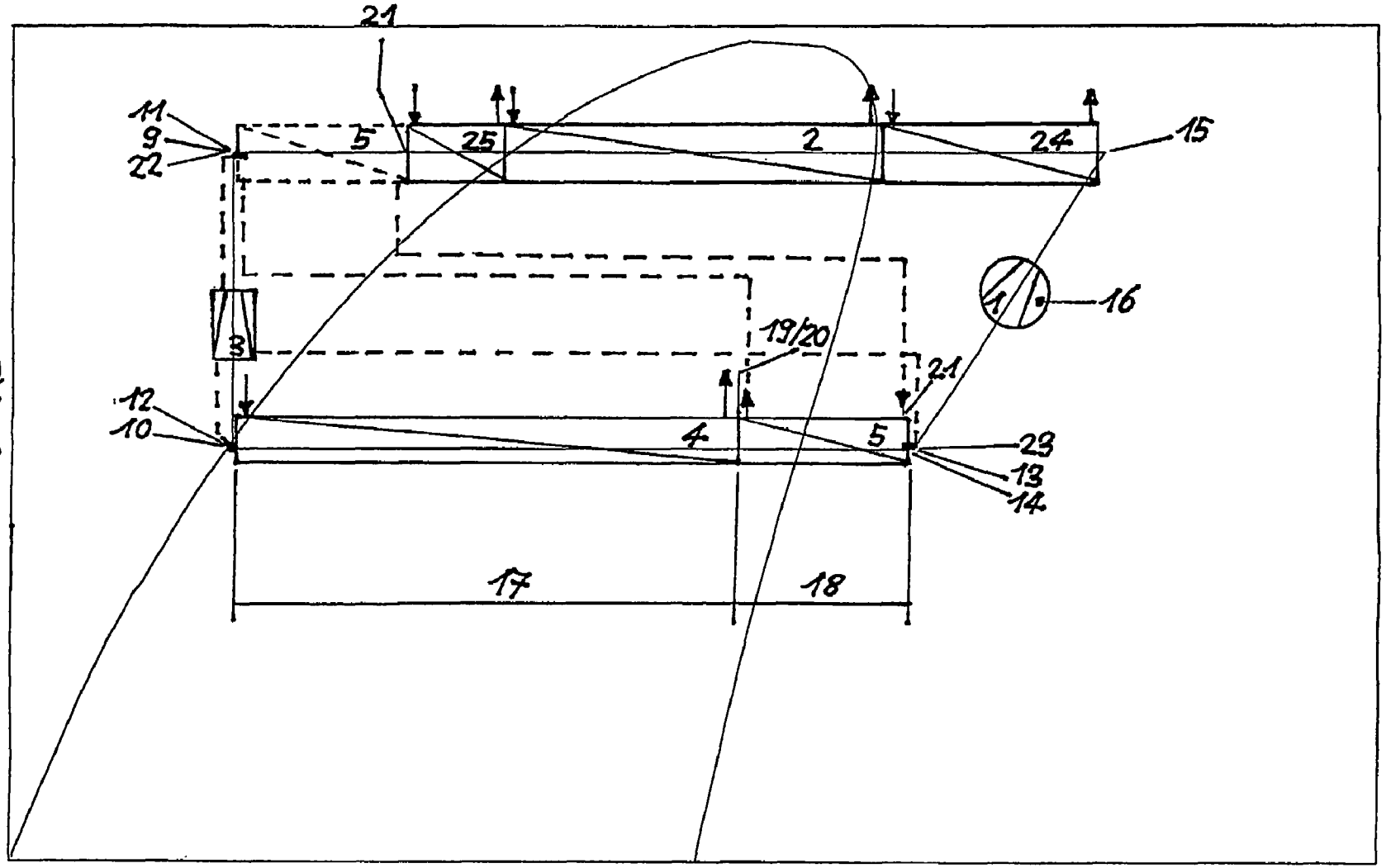
FIG. 9 shows the refrigerant circuit in the lg p, h diagram with two-stage evaporator of the "patent" with integrated equipment.
Figure 10:
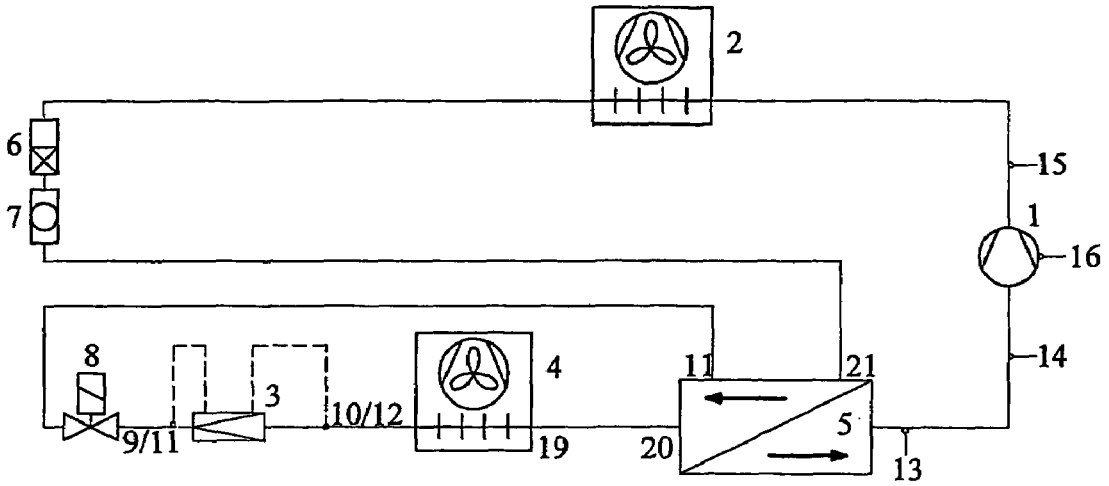
FIG. 10 shows the refrigerant circuit in the lg p, h diagram with two-stage evaporator of the "patent" with integrated equipment and two-stage supercooling (and deheater)
Figure 11:
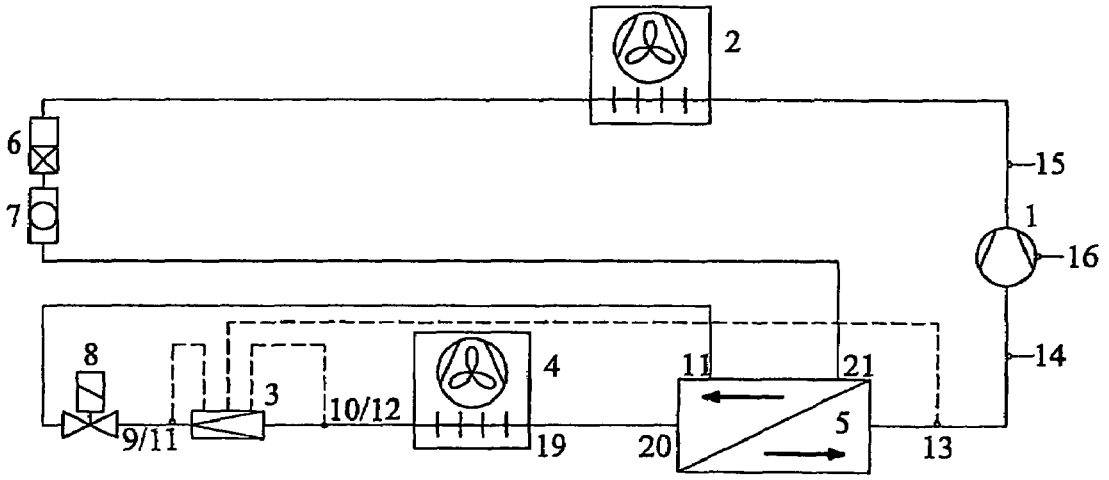
FIG. 11 shows the refrigerant circuit with evaporator and measured value combinations.
Figure 12:
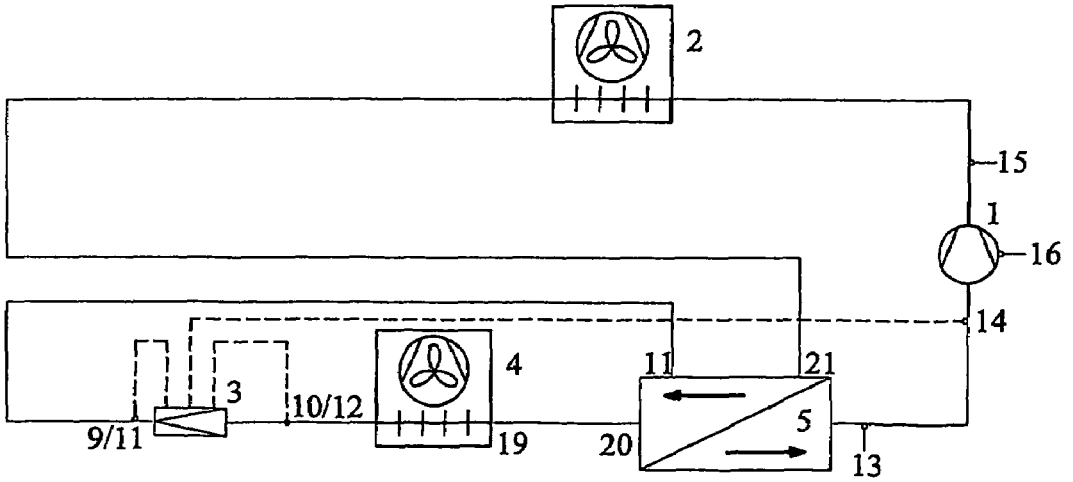
FIGS. 12-18 show different refrigerant circuits in accordance with the subject invention.
Figure 13:
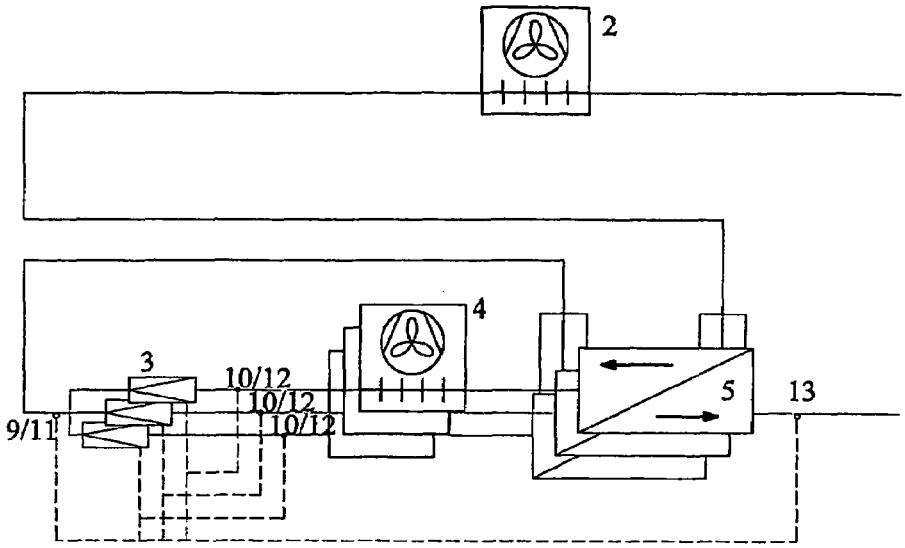
Figure 16:
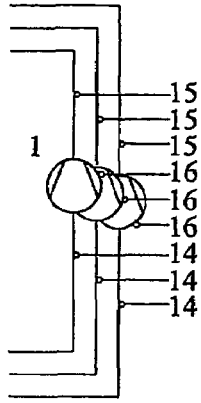
Figure 14:
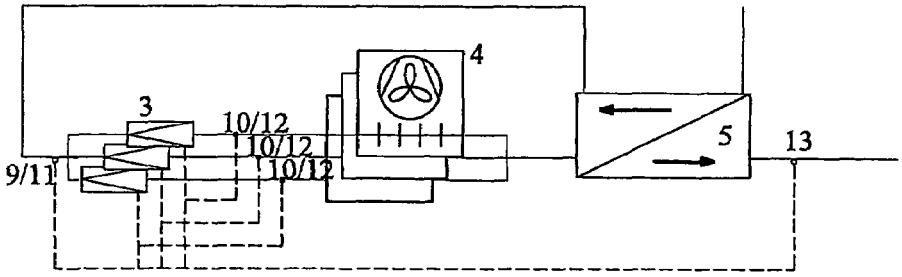
Figure 17:
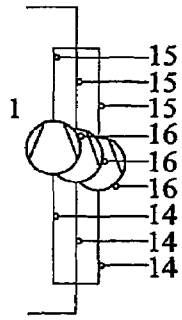
Figure 15:
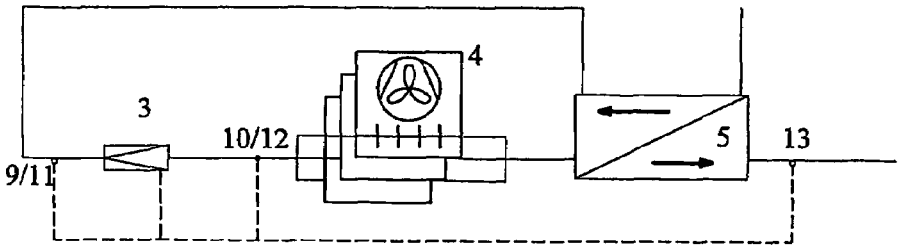
Figure 18:
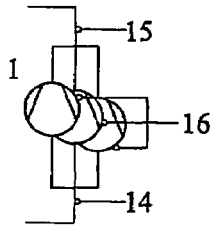

This IHE is installed between evaporator (4) and compressor (1), on one side, and between condenser (2) and expansion valve (3) on the other side (drawing FIG. 8, 9, 10).

On one side, liquid refrigerant flows through the IHE (5) (liquid side), and on the other side superheated refrigerant in vapor form or wet steam flows through the IHE (5).

Figure 4:
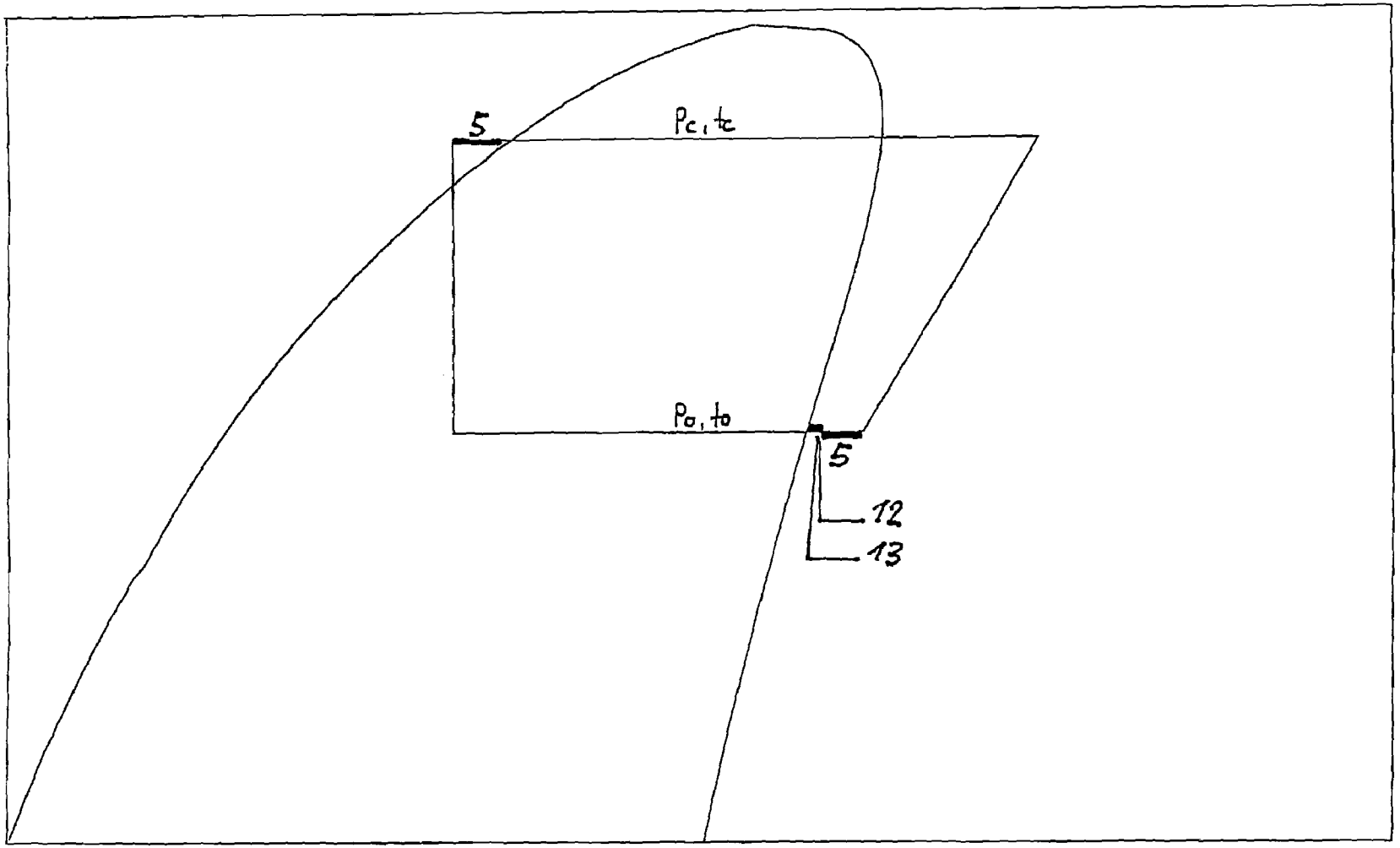
Fig. 4 PRIOR ART
FIG. 4 shows the refrigerant circuit in the lg p, h diagram with IHE of the "prior art"
Figure 5:
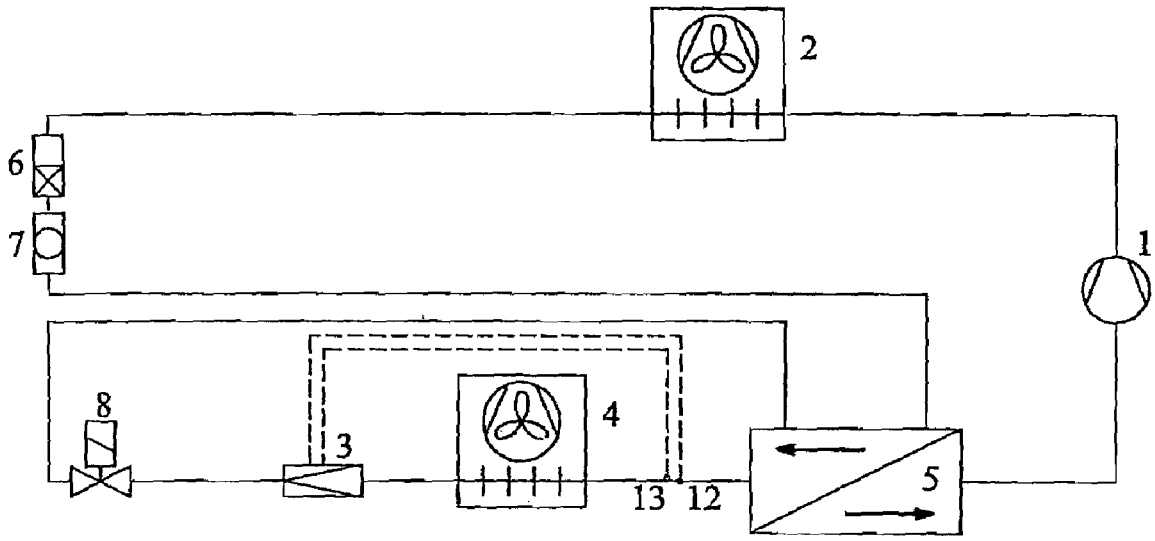
Fig. 5 PRIOR ART
FIG. 5 shows the refrigerant circuit with IHE of the "prior art"
Figure 6:
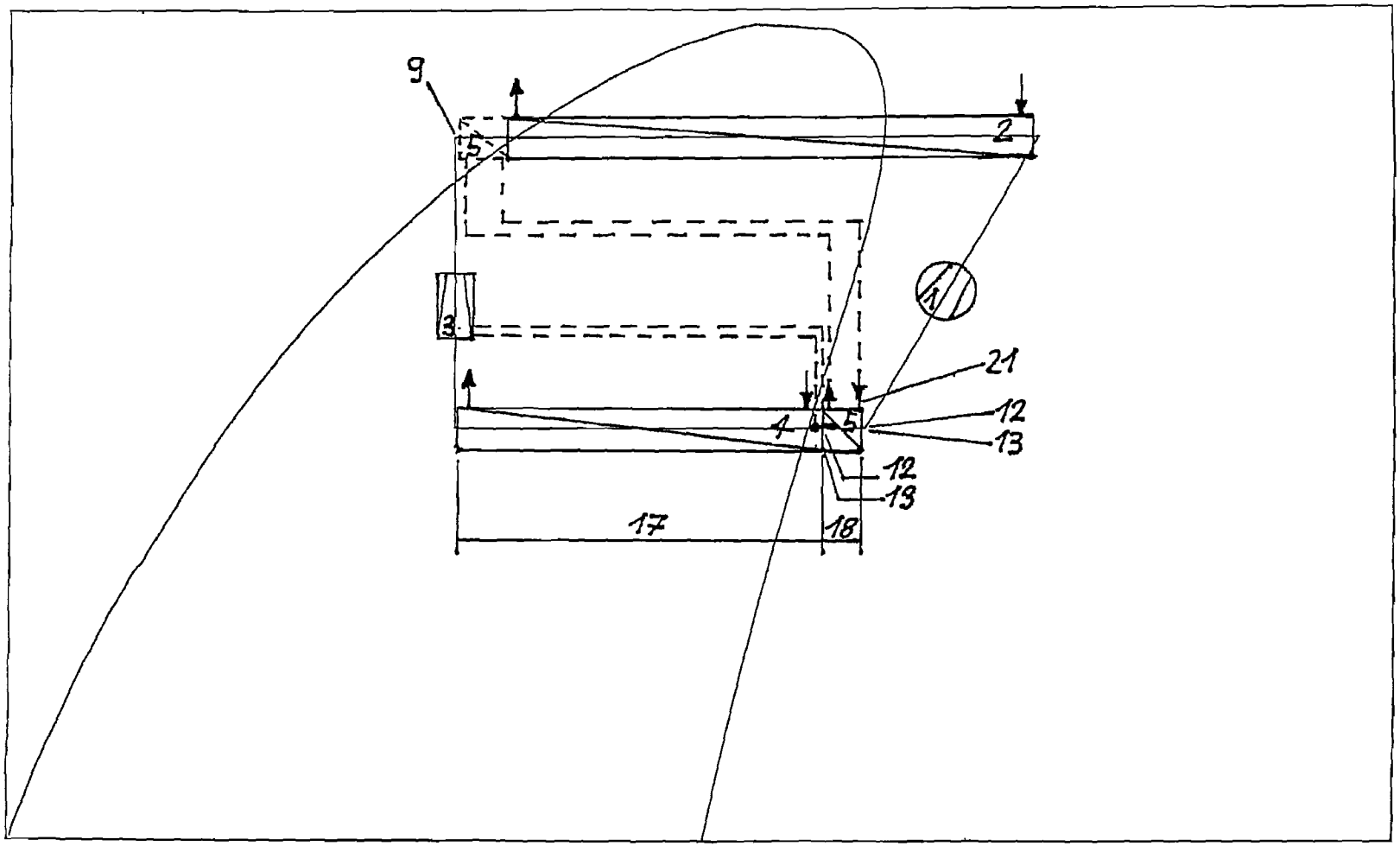
Fig. 6 PRIOR ART
FIG. 6 shows the refrigerant circuit with IHE of the "prior art" in the lg p, h diagram with integrated equipment.

If pure media (liquid refrigerant and superheated suction vapor) flow through the IHE, it is possible to speak of heat exchange (FIG. 4, 5, 6). If the IHE is operated with a liquid refrigerant and wet steam with subsequent suction vapor superheating, it is possible to speak of a second evaporation stage with integrated liquid supercooling and suction vapor superheating (FIG. 7, 8, 9, 10). The following text always encompasses both possible options.

The actual evaporation (first stage) (4) takes place partly or completely in the evaporator (4). To allow optimum operation of this evaporator (4), liquid refrigerant is admitted at the evaporator outlet.

Since liquid refrigerant is admitted at the evaporator outlet, for control of the evaporator (4) there is an absence of a measurement variable for determining the superheating, and the expansion valve (3) can no longer control the filling of the evaporator (4) with refrigerant.

The control for which a patent is hereby applied for the first time, as a novel feature, makes use of the measurement variables comprising the liquid temperature of the refrigerant upstream of the expansion valve (3) and the evaporator pressure (FIG. 7, 8, 9, 10, 11, points 9, 10, 11, 12).

It is in this context irrelevant what types or designs of evaporators and what refrigerants and application areas are involved.

The evaporator pressure is preferably taken at the inlet of the evaporator (12) (start of evaporation) (FIG. 7, 8, 9, 10, 11, point 12). In special cases, the exit pressure or any desired value derived from the two pressure measured values (refrigerant glide) can also be used as measured value (FIG. 7, 23).

Figure 1:
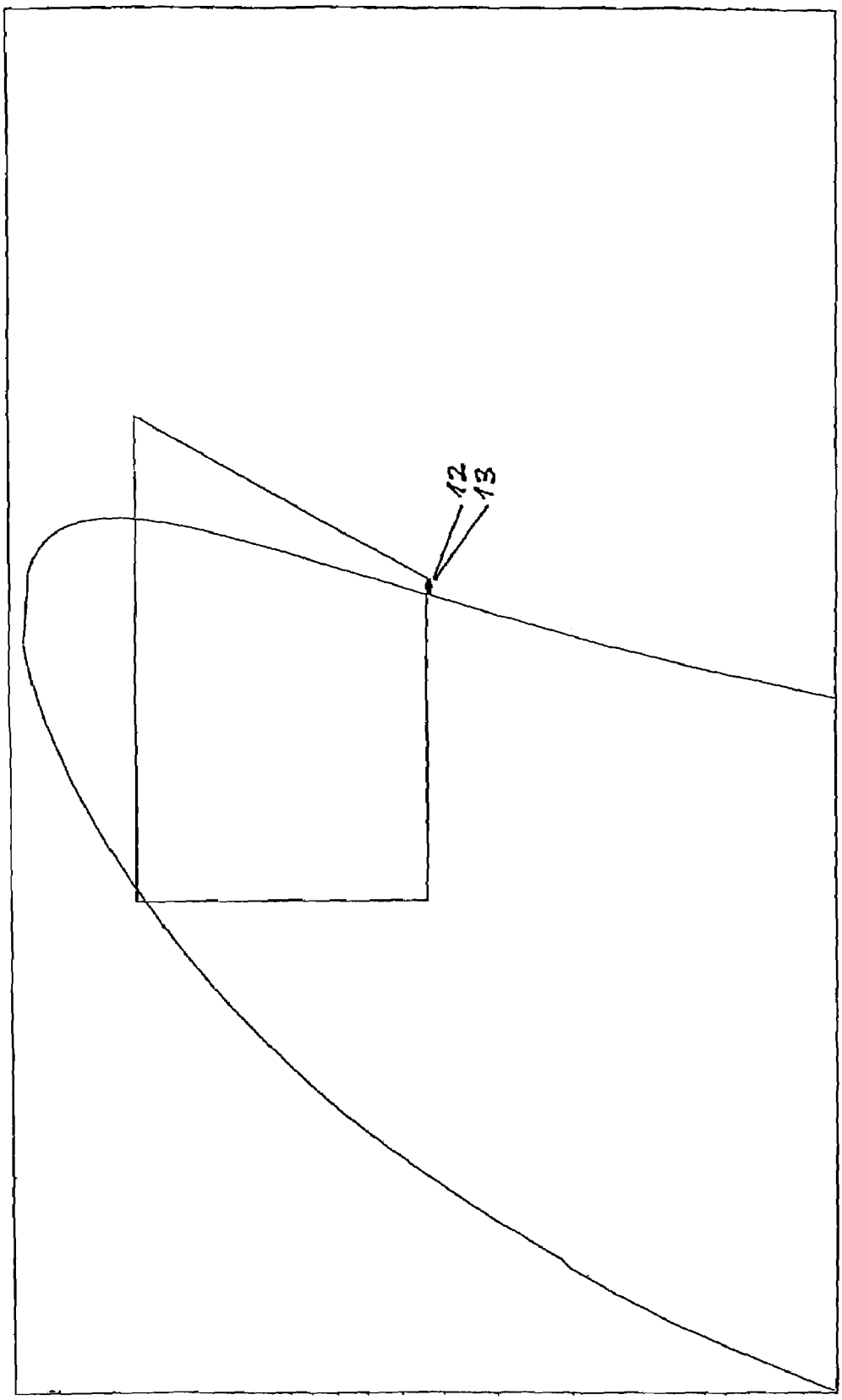
Fig. 1 PRIOR ART
FIG. 1 shows the refrigerant circuit in the "prior art" lg p, h diagram.
Figure 2:
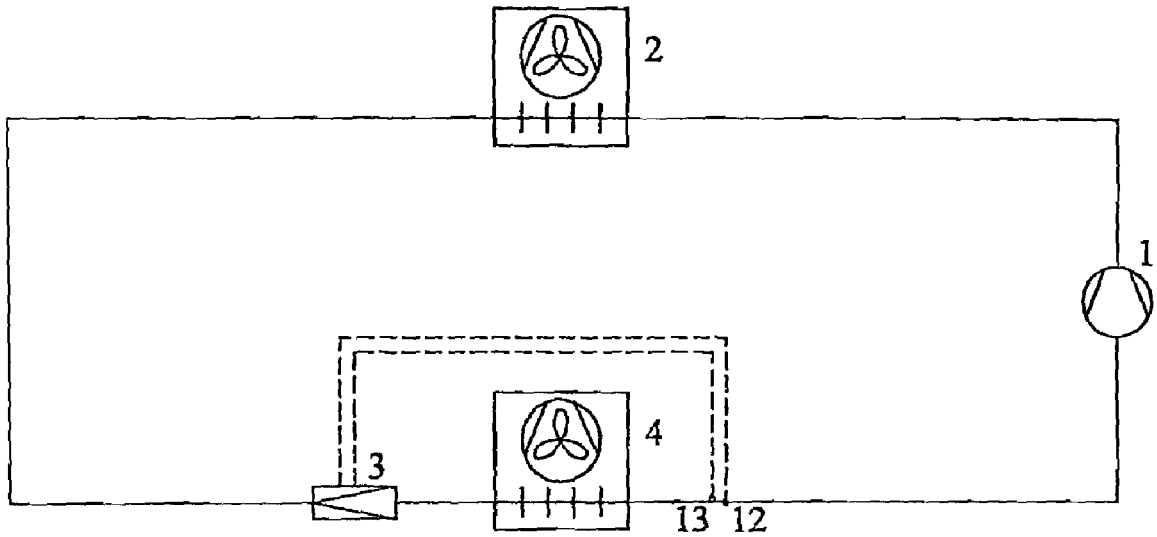
Fig. 2 PRIOR ART
FIG. 2 shows the "prior art" refrigerant circuit.
Figure 3:
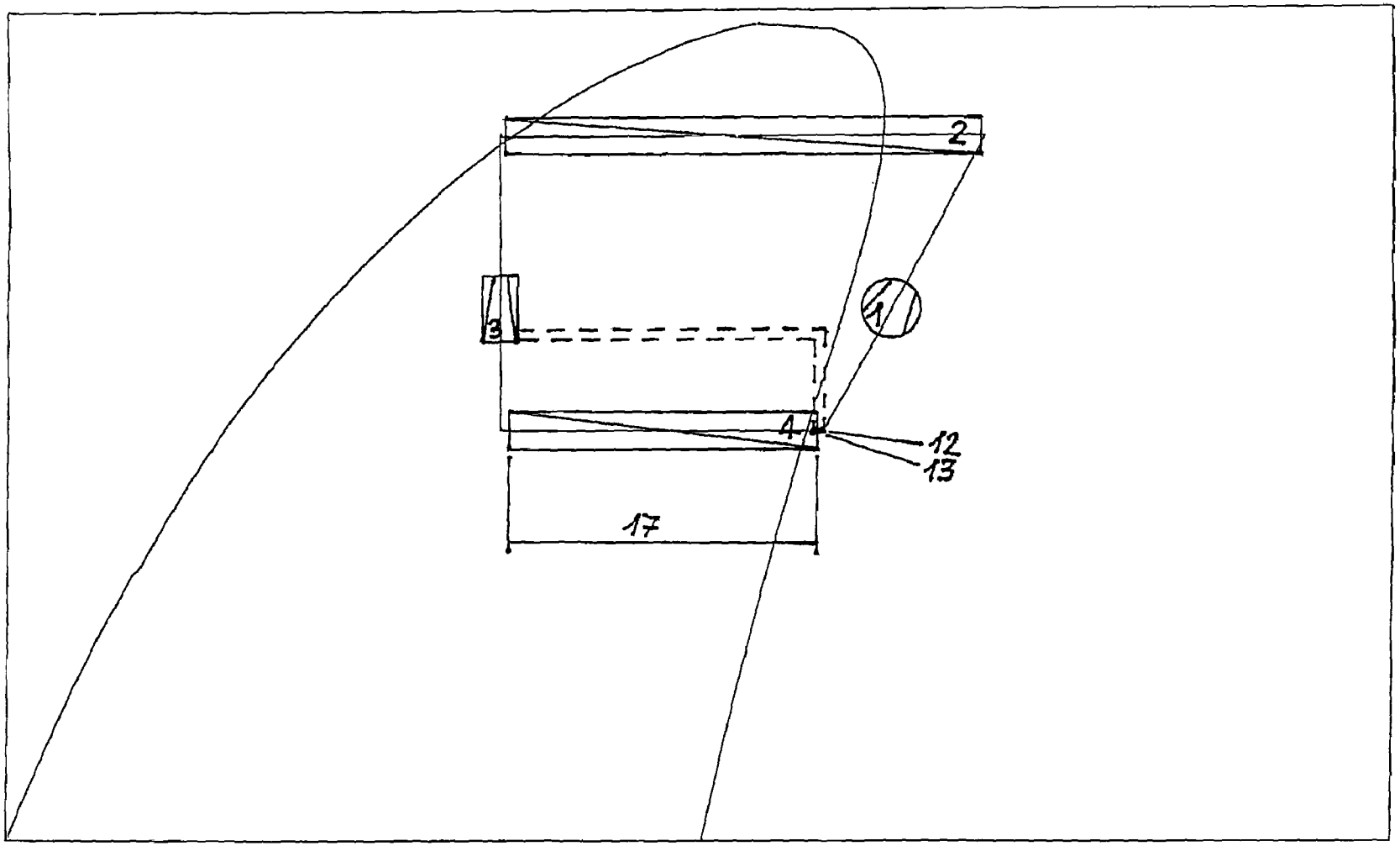
Fig. 3 PRIOR ART
FIG. 3 shows the refrigerant circuit in the lg p, h diagram with integrated equipment.

This control controls the start of the evaporation process (FIG. 7, points 11, 12) rather than, as has hitherto been the case, the end of evaporation (FIG. 3, points 12 and 13).

It is in this context irrelevant whether control is set to precisely the left-hand limit curve between refrigerant liquid and refrigerant wet steam in the lg p, h diagram of the refrigerant or to a value (to the left) or to the right of this limit curve.

With "optimized" evaporator designs, the evaporation process is started as close as possible to the left-hand limit curve of the lg p, h diagram. In the case of non-optimized evaporators, it may be advantageous for a certain proportion of gas to be admitted at the start of the evaporation process. In this case, the evaporation process is started to the right of this limit curve after the optimum for the respective evaporator.

The start of the evaporation process can be defined by the liquid temperature upstream of the expansion valve (11, 9) and the evaporation pressure (12, 10) (FIG. 7, 8, 9, 10, 11, points 11, 12, 9, 10)

The control variable can be defined, and the superheating controlled, from the evaporation pressure and a fixed (temperature) difference (adjustable) or from a stored curve calculation, depending on the refrigerant.

The injection valve (3) lowers the temperature of the refrigerant liquid (11) upstream of the injection valve (3) by opening the valve (3), and increases the refrigerant liquid temperature by closing the valve (3), thereby seeking to keep the desired value at a corresponding evaporation pressure (12).

The degree of flooding or superheating (19, 13) of the evaporator(s) (4) therefore determine the supercooling temperature of the liquid refrigerant (11) at a corresponding evaporation pressure (12) and the suction vapor temperature (13) at the compressor inlet (14).

When limit values are reached, such as for example the maximum permissible temperature for the compressor (13, 14, 15, 16), a further temperature-measuring sensor (optional) takes over and overcontrols the control of the refrigerant liquid entry temperature into the injection valve (11) on the basis of evaporator pressure (12) (FIG. 7, 9, 11, points 11, 12 and 13 (14, 15, 16)).

It is in this context irrelevant whether the suction vapor temperature at the exit of the IHE (5) (13), the suction vapor temperature at the compressor inlet (1) (14), the hot-gas temperature (compressor exit) (15), the oil temperature of the compressor (1) (16) or another suitable temperature is used as measurement variable for this safety and optimization function (FIG. 8, 9, 10, 11, points 13, 14, 15, 16).

In any event, an optimum-maximum supercooling (11) of the refrigerant liquid and an optimum-maximum suction vapor superheating (14) as a function of the corresponding compressor is always the aim, as a function of the evaporator type (FIG. 7, 9, 10, 11, points 11, 14).

It is in this context irrelevant whether the refrigeration system comprises one or a plurality of evaporators (4), one or a plurality of IHEs (5), one or a plurality of compressors (1), or one or a plurality of expansion valves (3), and whether or not they are combined to form groups. It is in this context also irrelevant whether or not one or more evaporators (4) are combined into groups with only one or more IHEs (5) (FIGS. 10-18, points 9, 10, 13, 14, 15, 16). Any combinations of expansion valves (3), evaporators (4), IHEs (5) and compressors (1) is therefore possible.

It is irrelevant whether the expansion valves (3) are of mechanical, thermal, electronic or other design and whether they control cyclically, continuously or in some other way. What is crucial is the process and control circuit, with the dependent relationships which have been listed between start of evaporation (11, 12), end of evaporation (13, 19) as a function of the refrigerant liquid entry temperature (21) to the IHE (5), the suction vapor exit temperature (13) from the IHE (5), the state of the refrigerant (wet steam (19) or superheated suction vapor (13)) on leaving the evaporator (19) and entering (20) the IHE (5), which in one case is operated as a second evaporator stage with subsequent high suction vapor superheating (13) and in another case, in the same plant, is operated as a pure heat exchanger for superheating the suction vapor (13). In this context, it is also irrelevant whether an external supercooler stage (25) connected upstream of the IHE (5) is connected to or disconnected from the process.

The advantage of this evaporator control consists in the fact that in this way the evaporator (4) is optimally flooded and utilized (drawing FIG. 7, 9, 10, 11, points 17, 19), that the pressure drop on the refrigerant side across the evaporator (4) is reduced, that as a result the evaporation temperature (23) is increased, that as a result smaller evaporators (4) can be used, that as a result the mass flow of refrigerant for a required refrigeration power is reduced, that as a result the compressors (1) are smaller (refrigeration production), that as a result less energy is required for the generation of refrigeration, that as a result efficiencies and the lubrication and therefore the service life of the compressors (1) are increased.

The control is set in such a way that the maximum power is always in favor of the evaporator (4) (FIG. 7, 8, 9 points 17) and not the IHE (5) (18) (maximum possible enthalpy distance at point 17).

Novelty:

A novel feature of our invention is that an evaporation system with dry expansion is used as flooded evaporator (4), in which the refrigerant leaves the evaporator (4) in the first stage with liquid fractions (17, 19).

A novel feature of our invention is that the refrigerant enters a second evaporation stage (5, 18, 20) (dry evaporator) as a liquid/gas mixture with a high gas content, and residual evaporation with subsequent high superheating of the refrigerant (13) and simultaneous supercooling of the liquid refrigerant on the second side of the IHE (5) takes place in this second evaporation stage (11).

A novel feature of our invention is that control is based on the start of evaporation (12) of the evaporation process and not on the end of evaporation (13).

A novel feature of our invention is that this control is run on the evaporator (1) with different suction vapor superheating levels (13) depending on the liquid entry temperature (21) to the IHE (5).

A novel feature of our invention is that the suction vapor superheating (13) is selected to be as high as possible.

A novel feature of our invention is that the expansion valve (3) used, which is installed outside or inside the evaporator, controls the refrigerant liquid temperature (11) before it enters the expansion valve (3).

A novel feature of our invention is that the expansion valve (3) used, which is installed outside or inside the evaporator (4), limits the suction vapor temperature at the entry to the refrigerant compressor (14) and at the same time controls the power of the internal supercooling (18) as a function of the evaporator power (17) available from the first stage (4).

The invention claimed is:

1. A method for controlling evaporators in refrigeration plants, which refrigeration plants comprise a refrigerant circuit with a compressor, a liquefier, an expansion valve, an evaporator, and an internal heat exchanger connected downstream of the evaporator, wherein the evaporation process of the refrigerant from at or near a supercooled liquid state to a saturated state occurs within the evaporator and the evaporation process from a saturated state to a superheated gas state occurs within the internal heat exchanger and wherein the onset of the evaporation process controlled, whereby the refrigerant is at or near a supercooled state at the inlet of the evaporator and the evaporation pressure of the refrigerant at the inlet of the evaporator is measured and used as a first control variable, whereby the refrigerant is in a supercooled liquid state upstream of the expansion valve and the temperature upstream of the expansion valve is measured and used as second control variable for the control of the expansion valve, so that in this way the start of evaporation is defined and controlled.

2. The method for controlling evaporators in refrigeration plants as claimed in claim 1, wherein the temperature of the vapor at the compressor inlet is measured, and said measured value is used to optimize this control and ensure protection for the compressor.

3. The method for controlling evaporators in refrigeration plants as claimed in claim 1, wherein the temperature at the exit of the compressor and/or the compressor oil temperature and/or the suction pressure at the compressor inlet and/or the pressure upstream of the expansion valve or downstream of the compressor are measured, and said measured values are used to optimize or protect the compressor.

4. The method for controlling evaporators in refrigeration plants as claimed in claim 1, wherein a refrigerant is used with a predetermined phase-boundary curve in an lg (p, h) diagram, said phase-boundary curve having a left-hand rising part, a maximum and a right-hand falling part, and control is effected, such that the start of the evaporation begins near to the left-hand part of said boundary-phase curve of the lg p, h diagram for said refrigerant.

5. The method for controlling evaporators in refrigeration plants as claimed in claim 1, wherein this type of control causes the evaporator to be flooded and the degree of flooding to be determined, and wherein the temperatures of the refrigerant suction vapor at the compressor inlet and of the refrigerant liquid are measured and at the same time are monitored and controlled.

6. The method for controlling evaporators in refrigeration plants as claimed in claim 1, wherein a temperature or pressure value of the refrigerant is measured within the circuit for limiting the vapor temperature upstream of the compressor, and said measured value for limiting the vapor temperature upstream of the compressor over-controls the evaporation control and keeps the vapor temperature constant at an optimum and/or maximum value as a function of the compressor.

7. The method for controlling evaporators in refrigeration plants as claimed in claim 6, wherein the measured value for limiting the vapor temperature upstream of the compressor over-controls the evaporation control and keeps the vapor temperature upstream of the compressor constant at an optimum and/or maximum value as a function of the compressor.

8. The method for controlling evaporators in refrigeration plants as claimed in claim 1, wherein a refrigerant is used with a predetermined phase-boundary curve in the lg (p, h) diagram, said phase-boundary curve having a left-hand rising part, a maximum and a right-hand falling part, and wherein the optimum of the process is always in favor of the evaporator and not the IHE to achieve maximum utilization of the enthalpy in the evaporator between the left-hand and right-hand parts of the phase-boundary curves of the lg (p, h) diagram for said refrigerant and, depending on the temperature level of the IHE, with a superheating component in the evaporator.

9. The method for controlling evaporators in refrigeration plants as claimed in claim 1, wherein one evaporator can be connected to one IHE, or a plurality of evaporators can be connected to one IHE or a plurality of evaporators can be connected to a plurality of IHEs, or any type of combinations thereof, to form a refrigeration system.

10. The method for controlling evaporators in refrigeration plants as claimed in claim 1, wherein, depending on the combination of evaporators, IHEs, expansion valves and compressors, each injection valve and the system can be controlled with reduced measured values.

11. The method for controlling evaporators in refrigeration plants as claimed in claim 10, wherein one measured value is controlled for each expansion valve.

12. The method for controlling evaporators in refrigeration plants as claimed in claim 10, wherein one measured value is controlled for each compressor.

13. The method for controlling evaporators in refrigeration plants as claimed in claim 10, wherein one measured value is controlled for a plurality of expansion valves.

14. The method for controlling evaporators in refrigeration plants as claimed in claim 10, wherein one measured value is controlled for a plurality of compressors.

15. The method for controlling evaporators in refrigeration plants as claimed in claim 1, wherein depending on the combination of evaporators, IHEs, expansion valves and compressors, each expansion valve and the system can be controlled with a combination of one or more measured values.

* * * * *

UNITED STATES PATENT AND TRADEMARK OFFICE

CERTIFICATE OF CORRECTION

PATENT NO. : 7,665,321 B2
APPLICATION NO. : 10/538700
DATED : February 23, 2010
INVENTOR(S) : Remo Meister It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 901 days.

Signed and Sealed this

Seventh Day of December, 2010

David J. Kappos

David J. Kappos
*Director of the United States Patent and Trademark Office*